US011276509B2

(12) United States Patent
Ito et al.

(10) Patent No.: US 11,276,509 B2
(45) Date of Patent: Mar. 15, 2022

(54) STRUCTURE CONTAINING METAL MICROPARTICLES

(71) Applicant: KYUSHU UNIVERSITY, NATIONAL UNIVERSITY CORPORATION, Fukuoka (JP)

(72) Inventors: Kengo Ito, Fukuoka (JP); Naohiro Takeda, Fukuoka (JP)

(73) Assignee: ITO RESEARCH INSTITUTE CO., LTD, Fujisawa (JP)

( * ) Notice: Subject to any disclaimer, the term of this patent is extended or adjusted under 35 U.S.C. 154(b) by 0 days.

(21) Appl. No.: 14/647,742

(22) PCT Filed: Nov. 5, 2013

(86) PCT No.: PCT/JP2013/080368

§ 371 (c)(1),
(2) Date: May 27, 2015

(87) PCT Pub. No.: WO2014/084026

PCT Pub. Date: Jun. 5, 2014

(65) Prior Publication Data

US 2015/0310958 A1 Oct. 29, 2015

(30) Foreign Application Priority Data

Nov. 29, 2012 (JP) ..... JP2012-260642

(51) Int. Cl.

| | |
|---|---|
| ***H01B 1/16*** | (2006.01) |
| ***H01B 13/30*** | (2006.01) |
| ***B05D 5/00*** | (2006.01) |
| ***B05D 3/00*** | (2006.01) |
| ***B22F 1/00*** | (2022.01) |

(52) U.S. Cl.

CPC ..... *H01B 1/16* (2013.01); *B05D 3/007* (2013.01); *B05D 5/00* (2013.01); *B22F 1/0055* (2013.01); *B22F 1/0059* (2013.01); *H01B 13/30* (2013.01)

(58) Field of Classification Search

None

See application file for complete search history.

(56) References Cited

U.S. PATENT DOCUMENTS 5,462,905 A 10/1995 Nagami et al.
2008/0213592 A1* 9/2008 Goia ..... B22F 1/0018 428/402
2012/0283336 A1* 11/2012 Grigorenko ..... B22F 1/0022 514/769
2014/0076384 A1 3/2014 Yamada et al.
2014/0353706 A1* 12/2014 Higashiuchi ..... C23F 11/182 257/98

FOREIGN PATENT DOCUMENTS

| | | | | |
|---|---|---|---|---|
| JP | 4-296394 | A | 10/1992 | |
| JP | 6-63400 | A | 3/1994 | |
| JP | 07173022 | * | 7/1995 | |
| JP | 07330527 | * | 12/1995 | |
| JP | 2001040287 | * | 2/2001 | |
| JP | 2006-37001 | A | 2/2006 | |
| JP | 2006-184247 | A | 7/2006 | |
| JP | 2007-134195 | A | 5/2007 | |
| JP | 2010-135140 | A | 6/2010 | |
| JP | 2012-166145 | A | 9/2012 | |
| WO | WO-2012111647 | A1 * | 8/2012 | ..... C01B 33/44 |
| WO | WO 2012/147945 | A1 | 11/2012 | |
| WO | WO 2013108773 | A1 * | 7/2013 | ..... C23F 11/182 |

OTHER PUBLICATIONS

Preparation, morphology, and antibacterial properties of polyacrylonitrile/montmorillonite/silver nanocomposites. Materials Chemistry and Physics 136 (2012) 613-623.*

Liang et al. Hierarchicial Transformation of Silver Morphologies on Clay Film from Spheres, Cubes, Rods to Lengthy Nano-Wires. Mater. Res. Soc. Symp. Proc. vol. 1450, Materials Research Society (Year: 2012).*

Borah et al., "Controlled nanopore formation and stabilization of gold nanocrystals in acid-activated montmorillonite", Applied Clay Science, 2010, vol. 49, pp. 317-323.

Burridge et al., "Silver nanoparticle-clay composites", Journal of Materials Chemistry, Jan. 21, 2011, vol. 21, No. 3, pp. 734-742.

International Search Report issued in PCT/JP2013/080368, dated Dec. 10, 2013.

(Continued)

*Primary Examiner* — Tanisha Diggs

(74) *Attorney, Agent, or Firm* — Birch, Stewart, Kolasch & Birch, LLP

(57) ABSTRACT

The present invention addresses the problem of providing a structure which comprises metal plate microparticles and a lipophilic clay-based intercalation compound and which exhibits excellent stability. The problem is solved by a structure as described above wherein: the metal plate microparticles are platy microparticles alone or a mixture thereof with polyhedral microparticles (including spherical microparticles); the platy microparticles have a thickness of 1 to 50 nm, a length of principal plate of 10 to 5000 nm and an aspect ratio thereof of 3 or more; and the weight ratio of the lipophilic clay-based intercalation compound to the metal plate microparticles is 0.01 to 50.

7 Claims, 4 Drawing Sheets

(56) References Cited

OTHER PUBLICATIONS

Mojovic et al., "Electrochemical behavior of silver-impregnated AI-pillared smectite in alkaline solution", Journal of Solid State Electrochemistry, Sep. 2010, vol. 14, No. 9, pp. 1621-1627.
PCT/ISA/237—Issued in PCT/JP2013/080368, dated Dec. 10, 2013.
Japanese Office Action, dated Jun. 14, 2016, for Japanese Application No. 2014-550106.
Matsumoto et al., "Preparation of Oil-dispersible Gold Nanoparticle-clay Composites and their Optical Characteristics," Proceedings III of the 91st CSJ Annual Meeting, The Chemical Society of Japan, Mar. 11, 2011, 3 pages, with an English abstract.
Japanese Decision of Refusal, dated Dec. 13, 2016, for Japenese Application No. 2014-550106, as well as an English Machine translation.
Japanese Office Action issued in the corresponding Japanese Patent Application No. 2014-550106 dated Nov. 14, 2017.
Japanese Pre-Appeal Reexamination Report (including an English translation thereof) issued in the corresponding Japanese Application No. 2014-550106 dated Jun. 1, 2017.
Japanese Appeal Decision and English translation for Application No. 2014-550106, dated Jun. 12, 2018.
Japanese Decision to Grant a Patent and English translation for Application No. 2017-047001, dated Jun. 5, 2018.
Japanese Office Action and English translation for Application No. 2014-550106, dated Feb. 27, 2018.
Japanese Office Action and English translation for Application No. 2017-047001, dated Jan. 16, 2018.
Korean Office Action dated Jul. 16, 2020 for Application No. 10-2015-7011973 with an English translation.

* cited by examiner

STRUCTURE CONTAINING METAL MICROPARTICLES

TECHNICAL FIELD

The present invention relates to a structure comprising metal microparticles and a specific lipophilic montmorillonite mineral group or mica mineral group.

BACKGROUND ART

Until now, various compositions containing metal microparticles that exploit the characteristics of fine metal particles have been proposed. For example, Patent Document 1 describes that precious metal microparticles are allowed to agglomerate in a flowable matrix as represented by smectite to obtain a composite having a stable agglomeration state.

Now, since the surface and the interlayer space of a montmorillonite mineral group (clay-based layered compound) such as smectite are hydrophilic, it has properties of showing affinity with a highly polar solvent such as water or dimethylsulfonamide but not with a solvent having low polarity such as toluene or ketonic solvent. Therefore, use of a montmorillonite mineral group such as smectite has been difficult to produce a composite of metal particles and a layered compound that has affinity with a substance having low polarity. Meanwhile, a composite of metal particles and a layered compound that has affinity with a substance with low polarity has industrial benefits such as: (1) good working efficiency due to good volatility; and (2) enhancement of a photoelectric conversion efficiency of an organic solar cell.

The present inventor had succeeded in accomplishing an invention of a method for producing a composite of metal particles and a layered compound which has good affinity with a substance having low polarity by intercalation of organic ions (Patent Document 2). This method, however, has problems such as: (1) use of metal particles (metal plate microparticles, etc.) other than metal colloids (metal particles, or metal particles whose surface is at least partially covered with a dispersant such as citric acid); and (2) further enhancement of the dispersion stability for practical use.

Patent Document 1: Japanese Unexamined Patent Application Publication No. 2006-184247

Patent Document 2: Japanese Unexamined Patent Application Publication No. 2012-166145

SUMMARY OF THE INVENTION

Problems to be Solved by the Invention

The present invention has an objective in obtaining a structure comprising metal plate microparticles and a lipophilic clay-based intercalation compound, which is excellent in dispersion stability and has practical stability.

Means for Solving the Problems

In order to solve the above-described problems, the present inventors have continued studies on a dispersion stabilizer for metal plate microparticles and consequently found that a structure which is excellent in dispersion stability and has practical stability can be obtained by mixing metal microparticles with a specific clay-based intercalation compound at a specific mixing ratio, thereby accomplishing the present invention. Examples of the shapes of the metal microparticles include a sphere, a cube, a cuboid, polyhedrons such as an octahedron, a star, a plate, a rod, a wire and a prism. In particular, the metal particles have a plate-like shape alone, or a mixture of a sphere, a cube, a cuboid or a polyhedron such as an octahedron and a plate-like shape so that the structure of the present invention shows various properties by controlling the ratio thereof.

Specifically, the present invention is a structure containing metal microparticles and a lipophilic clay-based intercalation compound at a weight ratio of 0.01 to 50. The metal microparticles are, for example, at least one selected from the group consisting of gold, silver, copper, platinum, palladium and rhodium. In addition, according to the present invention, at least some of the metal microparticles have plate-like shapes, where the plate-like metal microparticles have a thickness of 1 nm to 50 nm and the long axis of the principal plane of 10 nm to 5000 nm. Moreover, the aspect ratio of the plate-like metal microparticles is at least 3, and preferably 3 or more. Herein, an example of the metal microparticles contains at least silver.

Furthermore, a lipophilic clay-based intercalation compound belongs to a lipophilic montmorillonite mineral group or a mica mineral group. In a preferred embodiment, while the lipophilic clay-based intercalation compound is lipophilic smectite, lipophilic saponite or lipophilic hectorite, a synthetic compound may also be used as the lipophilic clay-based intercalation compound. The structure of the present invention is preferably a film-like structure.

In addition, the present invention is a method for producing a structure containing metal microparticles and a lipophilic clay-based intercalation compound at a weight ratio of 0.01 to 50, the method comprising Steps 1 to 3 below.

Step 1: step of preparing a dispersion solution containing metal microparticles, a clay-based intercalation compound and a liquid dispersion medium such that the weight ratio of the metal microparticles and the lipophilic clay-based intercalation compound is 0.01 to 50.

Step 2: step of coating the dispersion solution on a support to obtain a coated film.

Step 3: step of removing the liquid dispersion medium from the coated film.

In Step 1, the dispersion solution preferably contains a resin. Examples of the resin include at least one type selected from the group consisting of polyol, polycarboxylic acid, polysulfonic acid, polyether, polyester, polyamide, polyvinyl butyral, polysiloxane, polyvinyl pyrrolidone and polycation compounds.

Furthermore, the present invention is a structure containing polyhedron metal microparticles including spherical microparticles with an average particle size of 1 nm to 300 nm, plate-like metal microparticles with a thickness of 1 nm to 50 nm, a long axis of the principal plane of 10 nm to 5000 nm and an aspect ratio is 3 or more, and a lipophilic clay-based intercalation compound.

Effect of the Invention

According to the present invention, a structure having a practical strength can be obtained while maintaining the dispersion stability of the metal microparticles as much as possible. Furthermore, according to the present invention, a structure having a practical strength and that can easily absorb light by increasing the plasmon effect, a structure having a practical strength with increased transparency for visible light, and a structure having a practical strength with increased substance permeability can be obtained.

BEST MODES FOR CARRYING OUT THE INVENTION

Figure 1:
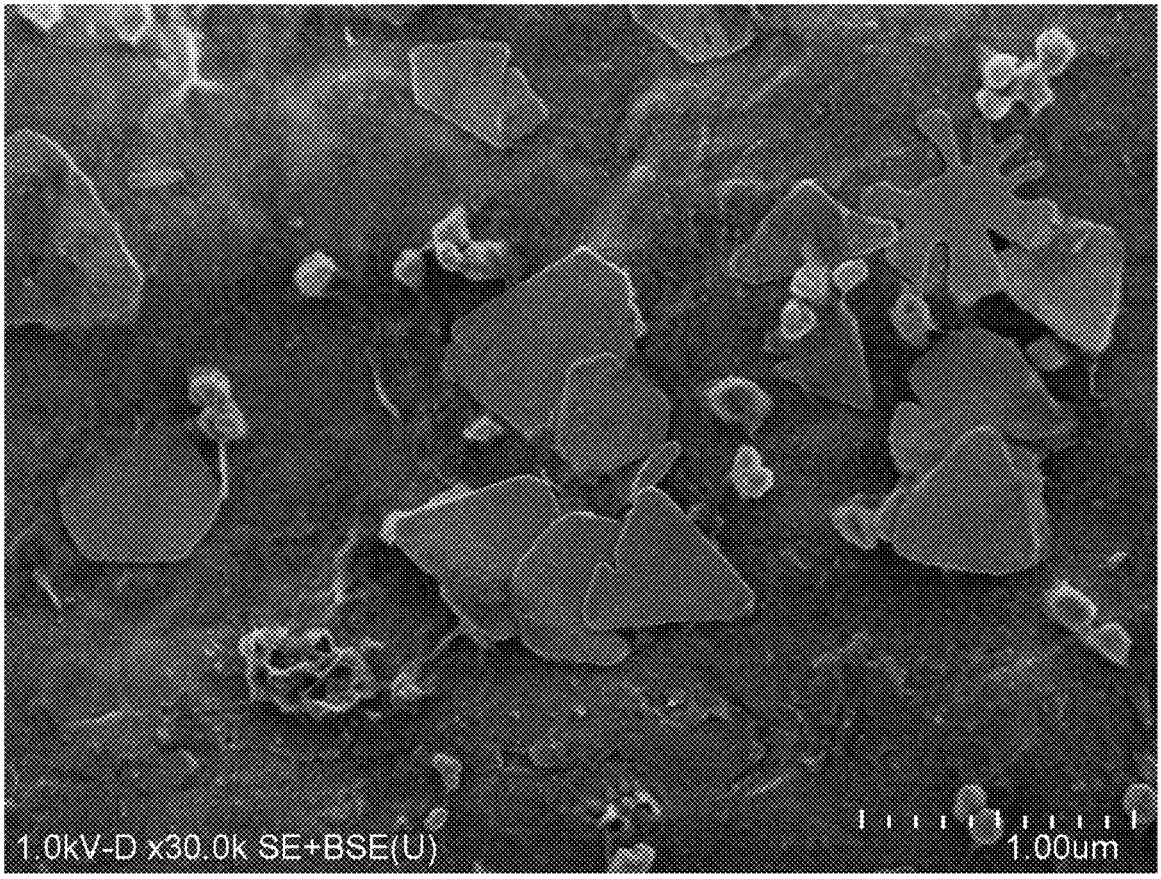
FIG. 1 A picture of a structure according to a first embodiment of the present invention taken with a scanning electron microscope.

Hereinafter, modes for carrying out the present invention will be described in detail.

A first embodiment of the present invention is a structure containing metal microparticles and a lipophilic clay-based intercalation compound at a weight ratio of 0.01 to 50.

Metal microparticles of a structure according to a second embodiment of the present invention consists of at least one selected from the group consisting of gold, silver, copper, platinum, palladium and rhodium.

Metal microparticles of a structure according to a third embodiment of the present invention have a plate-like shape, where the plate-like metal microparticles have a thickness of 1 nm to 50 nm, a long axis of the principal plane of 10 nm to 5000 nm, and an aspect ratio of 3 or more. In addition, another embodiment of a structure of the present invention contains plate-like metal microparticles alone, or a mixture of polyhedron metal microparticles including spherical microparticles with an average particle size of 1 nm to 300 nm and plate-like metal microparticles, where the weight ratio of the polyhedron microparticles including spherical microparticles is 10 or less with respect to the plate-like metal microparticles.

A structure according to a fourth embodiment of the present invention is a clay-based intercalation compound that is lipophilic. A structure according to another embodiment of the present invention has metal microparticles with a plate-like shape, where the thickness of said plate-like microparticles is 1 nm to 50 nm, the long axis of the principal plane of 10 nm to 5000 nm and the aspect ratio of 3 or more. The structure contains the plate-like microparticles alone or a mixture of it with polyhedron metal microparticles including spherical microparticles with an average particle size of 1 nm to 300 nm, and a lipophilic clay-based intercalation compound. The lipophilic clay-based intercalation compound may of a single type or a combination of multiple types of clay-based intercalation compounds.

The clay-based intercalation compounds of the present invention refer to a montmorillonite mineral group and a mica mineral group. The montmorillonite mineral group is a clay mineral represented by the following general formula $(X,Y)_{2-3}Z_4O_{10}(OH)_2.mH_2O—(W_{1/3})$ [wherein, X=Al, Fe(III), Mn(III), Cn(III); Y=Mg, Fe(II), Mn(II), Ni, Zn, Li; Z=Si, Al; W=K, Na, Ca; $H_2O$ is interlayer water; and m is an integer]. Here, depending on the difference in the combination as well as the number of substitution of X and Y, there may exist many types of natural products such as montmorillonite, magnesian montmorillonite, iron montmorillonite, iron magnesian montmorillonite, beidellite, aluminian beidellite, nontronite, aluminian nontronite, saponite, aluminian saponite, hectorite and sauconite. Other than these natural products, synthetic compounds and the like in which the OH group in the above-mentioned general formula is replaced by a halogen such as fluorine are also commercially available and any of them can be used.

The mica mineral group may be sodium silicic mica, sodium taeniolite or lithium taeniolite. In particular, a lipophilic clay-based intercalation compound that can be synthesized from a clay-based intercalation compound and $C_4$-$C_{20}$ alkyl quaternary ammonium cation is useful for the present invention. Examples include smectite such as Lucentite SAN, Lucentite SAN316, Lucentite STN, Lucentite SEN and Lucentite SPN (all trade names) from Co-op Chemical Co., Ltd., saponite (e.g., organified saponite) and bentonite from Kunimine Industries Co., Ltd., and hectorite (e.g., organified substance of synthetic hectorite) from Rockwood.

The average particle sizes of the polyhedron metal microparticles including spherical microparticles and the plate-like metal microparticles used with the present invention are measured by dynamic light scattering method, Sears method, laser diffraction/scattering method or the like. The aspect ratio of the plate-like metal microparticles is determined from an image observed using a scanning electron microscope.

Hereinafter, the first embodiment of the present invention will be described.

The first embodiment of the present invention is a structure in which a weight ratio of the metal microparticles and the lipophilic synthetic smectite (weight of lipophilic synthetic smectite/weight of metal microparticles) meets 0.01 to 50. The structure of the present invention may take a form of an aggregate which is formed such that the surfaces of the plate-like metal microparticles and the polyhedron metal microparticles including spherical microparticles are covered by smectite. Accordingly, a structure excellent in dispersion stability and also excellent in temporal stability can be obtained.

A microscopic picture of the structure according to the first embodiment the present invention taken with a scanning electron microscope is shown in FIG. 1. In this structure, the plate-like metal microparticles are covered with smectite, and they hardly agglomerate with other plate-like metal microparticles. In the above-described state, the structure exhibits special optical property due to the surface plasmon effect of the plate-like metal microparticles, and expresses a light absorbing effect. In this regard, it may be preferable, depending on the desired optical property, that the principal planes of about 2 to 5 plate-like metal microparticles are assembled/agglomerated with each other, and thus it is important to strictly control the agglomeration state of the plate-like metal microparticles upon producing the structure of the present invention.

According to the first embodiment of the present invention, the weight ratio of the metal microparticles and the lipophilic synthetic smectite (weight of lipophilic synthetic smectite/weight of metal microparticles) meets 0.01 to 50. If this weight ratio is less than 0.01, the dispersion stability would be insufficient and results in poor temporal stability. On the other hand, if the weight ratio is 50 or higher, the amount of smectite covering the plate-like metal microparticles and else becomes too much, resulting in low surface plasmon effect. In particular, the weight ratio is preferably 0.05 to 20 for the purpose of effectively expressing various optical properties of the plate-like metal microparticles.

The metal microparticles are plate-like microparticles alone or a mixture of polyhedron microparticles including spherical microparticles and plate-like microparticles. The plate-like metal microparticles have a thickness of 1 nm to 50 nm and a principal plane with a shape of a star, a triangle, a polygon, a substantial polygon or the like, where the long axis of said principal plane is 10 nm to 5000 nm and the aspect ratio thereof is 3 or more. In terms of interaction force between the plates such as the interactomic force and the van der Waals' force, the long axis of the plate-like metal microparticles is preferably 30 nm to 1500 nm.

The aspect ratio according to the present invention is the value obtained by dividing the long side of the principal plane by the thickness. Here, the plate-shaped principal plane has the largest area and refers to two planes facing each other, while the thickness refers to the side length sandwiched in between the two principal planes. Additionally, the shape of a star or a polygon of the principal plane refers to the shape of the principal plane projected in the normal direction. The long side of the principal plane refers to the longest part between a corner (apex) to a corner (apex) of the principal plane.

Hereinafter, the second embodiment of the present invention will be described.

While the structure according to the second embodiment of the present invention contains at least one of gold, silver, copper, platinum, palladium and rhodium as the metal microparticles, it preferably contains a single composition of any one of gold, silver or copper or an alloy containing at least one of them, and particularly preferably contains silver alone.

Hereinafter, the third embodiment the present invention will be described.

The third embodiment of the present invention is a structure that contains metal plate microparticles alone, or polyhedron metal microparticles including spherical microparticles having an average particle size of 1 nm to 300 nm and plate-like metal microparticles having a thickness of 1 nm to 50 nm, the long axis of the principal plane thereof of 10 nm to 5000 nm and the aspect ratio thereof of 3 or more, where the weight ratio of the metal microparticles is 10 or less with respect to the plate-like metal microparticles. Although the mixed amount of the polyhedron metal microparticles including the spherical microparticles may preferably be as small as possible for some cases, their existence is inevitable to some extent through the production steps or due to the fracture of the plate. According to the present invention, depending on the desired optical properties (for example, light-scattering property or the like), it may be more preferable that the polyhedron metal microparticles including spherical microparticles and the plate-like metal microparticles are mixed together for some cases, in which cases it is important to control the above-described weight ratio.

Figure 2:
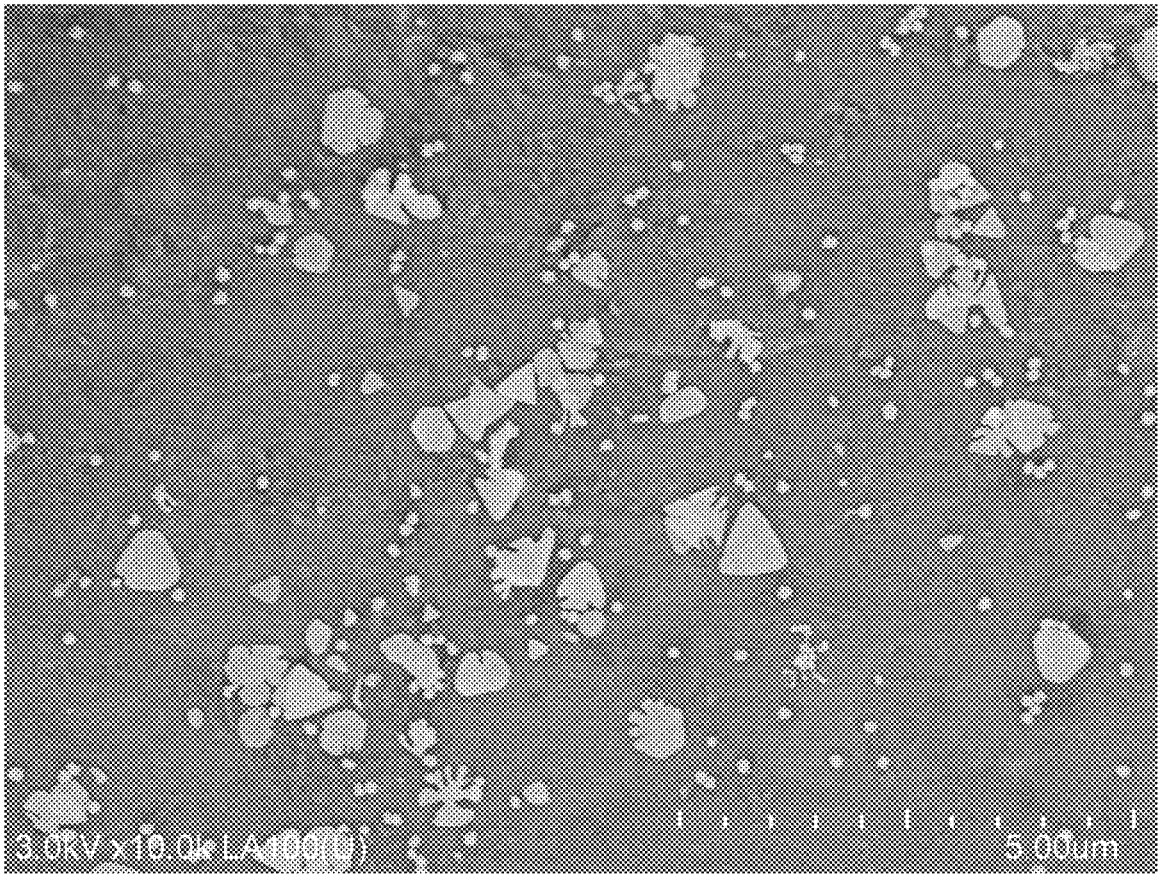
FIG. 2 A picture of a structure according to a third embodiment of the present invention taken with a scanning electron microscope.

A picture of the structure according to the third embodiment of the present invention taken with a scanning electron microscope is shown in FIG. 2. FIG. 2 shows the spherical metal microparticles attached to the plate-like metal microparticles, where both microparticles are covered with smectite.

Hereinafter, the fourth embodiment of the present invention will be described.

Figure 3:
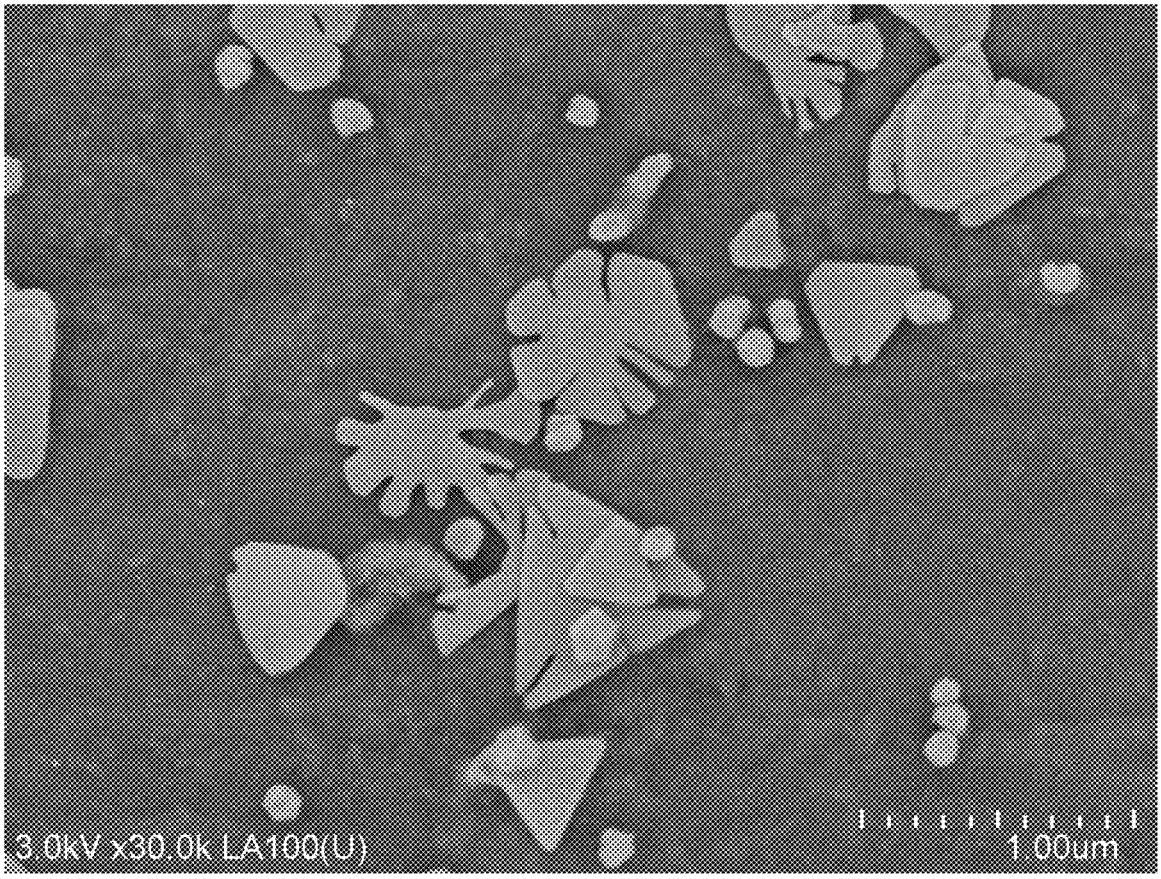
FIG. 3 A picture of a structure according to a fourth embodiment of the present invention taken with a scanning electron microscope.

The fourth embodiment of the present invention is a structure in which the smectite is a lipophilic synthetic smectite. A picture of the structure according to the fourth embodiment of the present invention taken with a scanning electron microscope is shown in FIG. 3. The lipophilic synthetic smectite can be finely dispersed or molecularly dissolved in a solvent to cover the metal microparticles and else. Since the metal microparticles and else can easily be dispersed in the solvent, it can be easily applied to a structure of the present invention and the formation of the film thereof becomes easy.

The structure of the present invention is made of a composite in which the surfaces of the metal microparticles are coated with a lipophilic clay-based intercalation compound. Another embodiment of a structure of the present invention may also take a form in which the metal microparticles are assembled or agglomerated in the above-described composite. Another embodiment of a structure of the present invention may alternatively take a layered form in which the metal microparticles are laminated in the above-described composite. According to another embodiment of a structure of the present invention, the above-described composite may also be used in a mixture, an assembly or a composition depending on use.

Although the structure of the present invention may have a film-like shape, a fiber-like shape, a particle-like shape or the like, a film-like shape is preferable from the perspective of the beneficial use of the expressed optical property, substance permeability, conductivity and else. In this case, in order to maintain the flexibility of the film, the thickness of the structure is preferably 10 μm or less.

Hereinafter, a method for producing a structure of the present invention will be described by taking a structure in a film-like form as an example. The structure of the present invention can efficiently be produced by utilizing a liquid dispersion medium (Steps 1 to 3).

Step 1: Step of preparing a dispersion solution containing metal microparticles, a lipophilic clay-based intercalation compound and a liquid dispersion medium such that the weight ratio of the metal microparticles and the lipophilic clay-based intercalation compound is 0.01 to 50.

Step 2: Step of coating the dispersion solution onto a support to obtain a coated film.

Step 3: Step of removing the liquid dispersion medium from the coated film.

Typically, the dispersion solution used with the present invention may be prepared, for example, according to any one of the following methods [1] to [4], although the method for preparing the dispersion solution is not limited these methods.

[1] Method in which metal microparticles and a lipophilic clay-based intercalation compound used are all added to and dispersed in a common liquid dispersion medium at the same time.

[2] Method in which metal microparticles are dispersed in a liquid dispersion medium to prepare a metal microparticle dispersion solution while a lipophilic clay-based intercalation compound is dispersed in a liquid dispersion medium to separately prepare a lipophilic clay-based intercalation compound, and subsequently the respective dispersion solutions are mixed.

[3] Method in which metal microparticles are dispersed in a liquid dispersion medium to prepare a metal microparticle dispersion solution, to which a lipophilic clay-based intercalation compound is added and dispersed therein.

[4] Method in which metal microparticles are formed in a liquid dispersion medium to prepare a metal microparticle dispersion solution containing the metal microparticles while a lipophilic clay-based intercalation compound dispersion solution containing a lipophilic clay-based intercalation compound is separately prepared, and subsequently the respective dispersion solutions are mixed.

In order to achieve more homogeneous dispersion, the dispersion solution is subjected to forced dispersion procedure such as ultrasonic dispersion, ultrahigh-pressure dispersion or the like, thereby homogeneously dispersing the metal microparticles in the dispersion solution. In addition, the lipophilic clay-based intercalation compound and the metal microparticles used for preparing the dispersion solution are preferably in colloid states.

The liquid dispersion medium of the present invention may be any medium as long as it has the function to allow dispersion of the metal microparticles and else. Water or an organic solvent may be used. Moreover, the metal microparticles may be subjected to surface treatment in order to improve the dispersibility in the above-described solvent, or may be added with a dispersion medium electrolyte or a dispersant assistant.

If the metal plate microparticles and smectite are to be dispersed in colloidal states in Step 1 mentioned above, pH may be adjusted, or an electrolyte, in particular citric acid or other similar organic acid and a dispersant may be added, as necessary. Furthermore, for homogeneous dispersion, a procedure such as stirring with a stirrer, ultrasonic dispersion or ultrahigh-pressure dispersion (ultrahigh-pressure homogenizer) may be employed if necessary. The concentration of the smectite dispersion solution is not particularly limited, but it is desirable to be 1 to 50% by weight so as to maintain stability in the solution of the metal plate microparticles.

According to the present invention, the dispersion solution may contain a resin. Examples of the resin include at least one type selected from the group consisting of polyol, polycarboxylic acid, polysulfonic acid, polyether, polyester, polyamide, polyvinyl butyral, polysiloxane, polyvinyl pyrrolidone and polycation compound, which may be used alone or in a suitable combination.

In Step 2 mentioned above, the method for coating the dispersion solution onto the support is not particularly limited. For example, a known method such as gravure coating, reverse coating, roll coating, spray coating, die coating or bar coating may be used for application.

In Step 3 mentioned above, the pressure and the temperature upon the step of removing the liquid dispersion medium from the coated film may appropriately be selected according to the smectite, the metal plate microparticles and the liquid dispersion medium used. For example, if the liquid dispersion medium is water, the liquid dispersion medium can be removed at 25° C. to 60° C. under a normal pressure.

EXAMPLES

Hereinafter, the present invention will be described specifically by means of examples, although the present invention is not limited to these examples. Various improvements and modifications are included without departing from the spirit of the present invention.

Example 1

The main materials used were as follows.

[Silver Nanoparticle Aqueous Dispersion]

As a silver nanoparticle aqueous dispersion, a prototype from Dai Nippon Toryo was used. This dispersion solution was an aqueous dispersion of mixed-type silver nanoparticles that contains plate-like particles and polyhedron particles including spherical particles. The average long axis of the principal plane of the plate-like microparticles was 500 nm to 800 nm and the thickness thereof was 10 nm to 20 nm. The average particle size of the spherical particles was 150 nm. The content of silver in the dispersion solution was 0.006% by weight.

[Preparation of Lipophilic Clay-Based Intercalation Compound]

1 gram of synthetic saponite from Kunimine Industries Co., Ltd. (trade name: SA) was dispersed in 60 ml of pure water so as to form microparticles, thereby preparing a dispersion solution. A solution obtained by dissolving 1 gram of benzyloctadecyl dimethyl ammonium chloride into 60 ml of pure water heated to 50° C. in advance was added to a microparticle dispersion solution containing the above-described saponite, while stirred with heat at 50° C. At the end of mixing, stirring was continued for an hour. Thereafter, the solution was left overnight and the temperature was allowed to return to room temperature. The resulting precipitated white sediment was filtered, collected, washed with 100 ml of pure water followed by cold methanol and dried.

[Preparation of Silver Nanoparticle-Lipophilic Clay Composite]

1% by weight of toluene dispersion solution of the above-described lipophilic synthetic clay was prepared. 11 ml of viscous liquid was collected, diluted with 9 ml of a mixed solvent of dichlorobenzene: chloroform=1:3 (vol/vol), then added and well shaken with 100 ml of the above-described silver nanoparticle aqueous dispersion. The resultant was subjected to extracting operation and left alone, which resulted three separated layers, i.e., a water phase, a bluish-green phase and an ocher color phase from the top. The ocher color phase was collected from the separated layer, to which a mixed solvent of a large amount of water and ethanol was added, thereby obtaining beige sediment. This sediment was collected, filtered, washed with a large amount of ethanol and then dried. This collected substance was dispersed in a mixed solvent of DMSO and water to obtain a dispersion solution, which was used to form a film. In a picture of this film taken with a scanning electron microscope, plate-like silver nanoparticles embedded in a large amount of fine lipophilic synthetic clay were observed.

Example 1 was assessed according to the following method.

The above-described silver nanoparticle-lipophilic clay composite was used to prepare a dispersion solution for application that will be described in the following section. The dispersion solution was directly applied on the light-receiving surface of the silicon photodiode (S2386-8K from Hamamatsu Photonics) to form a film (dried), and then the photocurrent resulting from light irradiation was measured with a potentiostat-galvanostat (COMPACTSTAT from Ivium Technologies). In order to confirm the increase in the photocurrent upon application of the composite dispersion solution, the ratio of the photocurrent before and after the application of the composite (photocurrent after application of the composite/photocurrent before application of the composite) was determined with the same silicon photodiode. The light radiated on the silicon photodiode was the light emitted directly from the Xe lamp as the light source of HM-25Q hyper monolight from JASCO Corporation while setting the wavelength counter to 0 nm.

[Preparation of Silver Nanoparticle-Lipophilic Clay Composite Dispersion Solution Used for Application onto Silicon Photodiode]

The sediment (powdery) of the above-described composite of silver nanoparticles and lipophilic clay collected was dispersed in a mixed solvent of γ-butyrolactone: IPA=1:1 (vol/vol) to form microparticles (first IPA was used for dispersion followed by addition of γ-butyrolactone and the resultant was subjected to ultrasonic dispersion for about 30 minutes). The resulting dispersion solution was used and directly applied onto the light-receiving surface of the silicon photodiode to form a film (dried). Then, the photocurrent of the silicon photodiode was measured according to the above-described technique, confirming an increase in the photocurrent by approximately 4% as compared to the case before the application.

Comparative Example 1

Preparation of Composition of Silver Nanoparticle-Hydrophilic Clay Composite In the preparation of the composite of silver nanoparticles and lipophilic clay shown in Example 1, hydrophilic synthetic saponite that was not substituted with quaternary ammonium (synthetic saponite from Kunimine Industries Co., Ltd., trade name: SA) was directly used, instead of lipophilic synthetic clay, to prepare 1% by weight of an aqueous dispersion. 11 ml was taken from the prepared dispersion solution, and added with 100 ml of the silver nanoparticle aqueous dispersion described in Example 1 followed by 9 ml of a mixed solvent of dichlorobenzene: chloroform=1:3 (vol/vol). Thereafter, the solution was well shaken, subjected to extracting operation and left alone, which resulted two separated layers, i.e., a grayish black water phase and a colorless transparent organic phase from the top. From the separated layers, the grayish black phase was taken and added with a large amount of ethanol to filtrate the sediment. The filtrated sediment was washed with a large amount of ethanol and then dried.

Next, in the same manner as the preparation of the dispersion solution of the composite of silver nanoparticles and lipophilic clay for application onto a silicon photodiode described in Example 1, the sediment (powdery) of the composite of silver nanoparticles and hydrophilic clay collected as described above was dispersed in a mixed solvent of γ-butyrolactone: IPA=1:1 (vol/vol) to form microparticles. As a result, a grayish black dispersion solution was obtained, which immediately gave black sediment when left alone, revealing that the dispersion stability as a paint was extremely poor.

Moreover, in the same manner as Example 1, this dispersion solution was directly applied onto the light-receiving surface of the above-described photodiode and dried. As a result, agglomerates were occasionally observed and did not form a uniform coating. Subsequently, an assessment method similar to that in Example 1 was employed to measure the photocurrent of the silicon photodiode. As a result, photocurrent that was only about 70% of that before the application was obtained, showing no sign of amplification of the photocurrent, unlike Example 1.

Example 2

Preparation of Plate-Like Silver Nanoparticle Aqueous Dispersion

A plate-like silver nanoparticle aqueous dispersion was prepared in the following procedure (silver content: 0.001% by weight). All of the reagents used were Wako Special Grade from Wako Pure Chemical Industries.

(i) 250 μl of a 150 mM trisodium citrate aqueous solution, 50 μl of a 50 mM silver nitrate aqueous solution and 60 μl of 30% hydrogen peroxide water were sequentially added to 24 ml of ultrapure water while stirring.

(ii) 125 μl of a 100 mM sodium tetrahydroborate aqueous solution prepared at ice temperature was added while stirring more vigorously.

(iii) Vigorous stirring was continued at least for 30 minutes after the addition of the sodium tetrahydroborate aqueous solution. The resultant was left to stand for another five days or longer, thereby obtaining an aqueous dispersion of silver nanoplate nuclei a.

(iv) 1250 μl of the above-described aqueous dispersion of silver nanoplate nuclei a and 65 μl of a 20 mM ascorbic acid aqueous solution were sequentially added to 18 ml of ultrapure water while stirring.

(v) 4750 μl of a 0.5 mM silver nitrate aqueous solution was added at a flow rate of 1000 μl/min while stirring more vigorously.

(vi) Immediately after the addition of the above-described silver nitrate aqueous solution, 1000 μl of a 150 mM trisodium citrate aqueous solution was added and the stirring rate was slowed down. After 4 hours of continuous stirring, an aqueous dispersion of silver nanoplate nuclei b was obtained.

(vii) 1250 μl of the above-described aqueous dispersion of silver nanoplate nuclei b and 78 μl of a 20 mM ascorbic acid aqueous solution were sequentially added to 18 ml of ultrapure water while stirring.

(viii) 5700 μl of a 0.5 mM silver nitrate aqueous solution was added at a flow rate of 1000 μl/min while stirring more vigorously.

(ix) At the end of the addition of the above-described silver nitrate aqueous solution, the stirring rate was slowed down, and stirring was continued for another 4 hours, thereby obtaining an aqueous dispersion of plate-like silver nanoparticles.

Figure 4:
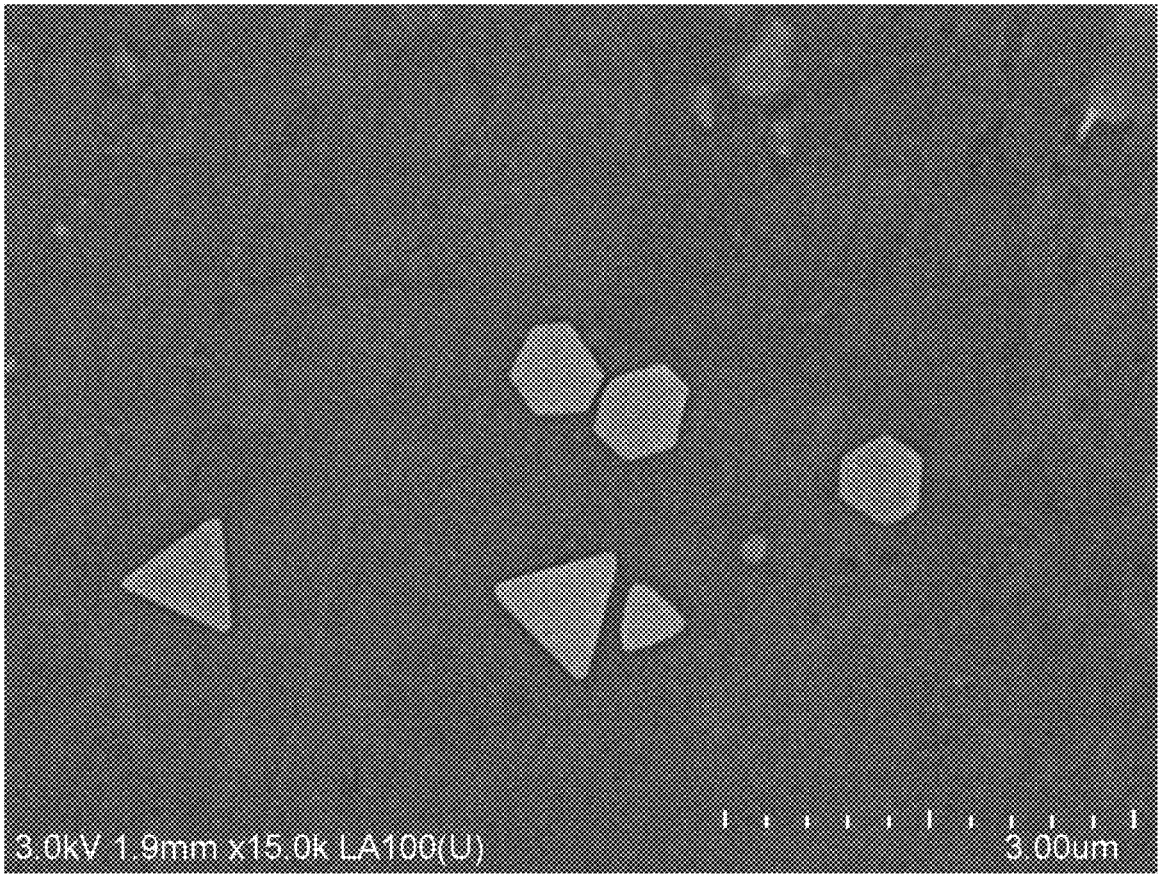
FIG. 4 A picture of the plate-like silver nanoparticle A aqueous dispersion (dried product) prepared in Example 2 taken with a scanning electron microscope.

The finally obtained silver nanoplate aqueous dispersion was dried and observed with SU8000 series scanning electron microscope from Hitachi. As a result, the shapes of the principal planes of the silver nanoplates were a triangle or a hexagon, where the long axis of the principal plane was 500 nm or longer, the thickness was 10 to 20 nm, and no spherical silver nanoparticles were found to be contained (see FIG. 4).

[Preparation of Plate-Like Silver Nanoparticle-Lipophilic Clay Composite]

1% by weight of dichlorobenzene dispersion solution of the lipophilic synthetic clay described in Example 1 was prepared. Then, 0.1 ml was taken from the prepared dispersion solution, diluted with dichlorobenzene to 2 ml, then added and well shaken with 100 ml of the above-described silver nanoplate aqueous dispersion, subjected to extracting operation and left alone, which resulted an organic phase with a fairly pale light blue color. Since the water phase that presented the pale light blue color became completely colorless upon leaving alone, most of the plate-like silver nanoparticles in the water phase seemed to have moved to the organic phase and condensed upon forming a composite with the lipophilic synthetic clay. The condensation rate numerically reached 100 ml/2 ml=50 times.

Next, a polyvinyl butyral resin was added to this organic phase solution to 0.005% by weight to obtain a paint material. Subsequently, an equivalent amount of ethanol was added to said material, and the resultant was applied onto a glass substrate that had underwent alkaline wash. The resultant was heat dried with a drier. As a result, a coating having almost colorless and transparent interference fringes was formed, which was confirmed to keep adhesion even upon contact with alcohol. Moreover, the surface resistance of said coating was measured to be at a value of around $10^3$ Ω/sq. at normal temperature and pressure, confirming an effect of significantly increasing conductivity that was higher by six figures or more than that in the case of glass substrate only.

Comparative Example 2

Preparation of Plate-Like Silver Nanoparticle-Hydrophilic Clay Composite

1% by weight of an aqueous dispersion of the hydrophilic synthetic saponite described in Comparative Example 1 was prepared. 0.1 ml was taken from the prepared dispersion solution, added with 100 ml of the silver nanoplate aqueous dispersion described in Example 2, then added and well shaken with 2 ml of dichlorobenzene, subjected to extracting operation and left alone, which resulted a colorless and transparent organic phase, unlike Example 2. The water phase that presented pale light blue color maintained its nature while it was left alone. Accordingly, most of the plate-like silver nanoparticles of the water phase seemed to have remained in the water phase.

Next, a polyvinyl alcohol resin was added to this water phase solution to 0.005% by weight to obtain a paint material. Subsequently, an equivalent amount of ethanol was added to this material and the resultant was applied onto a glass substrate that had underwent alkaline wash. The resultant was heat dried with a drier. As a result, an ununiform coating with scattering agglomerates was formed. This dry coating easily peeled off from the substrate upon contact with alcohol. Moreover, the surface resistance of said coating was measured to be at a value of around $10^{10}$ Ω/sq. at normal temperature and pressure, which was enormously large and cannot be compared with Example 2.

Example 3

Preparation of Naturally-Derived Lipophilic Clay-Based Intercalation Compound 1 gram of natural montmorillonite (from Kunimine Industries Co., Ltd., trade name: Kunipia F) was dispersed in 60 ml of pure water in microparticles to prepare a dispersion solution. A solution, in which 0.5 grams of trimethyl octadecyl dimethyl ammonium chloride was dissolved in 60 ml of pure water that had been heated to 50° C., was added to the above-described microparticle dispersion solution containing the natural montmorillonite while stirring and heating at 50° C. After mixing the solution, an hour of stirring was continued and the resultant was left overnight so that the temperature was allowed to return to room temperature. Pale yellow sediment precipitated. The precipitated sediment was filtered, collected, washed with 100 ml of pure water and cold methanol in this order and dried.

[Preparation of Composite of Plate-Like Silver Nanoparticles and Naturally-Derived Lipophilic Clay]

1% by weight of a dichlorobenzene dispersion solution of the above-described naturally-derived lipophilic synthetic clay was prepared. 0.1 ml was taken from the prepared dispersion solution, diluted to 2 ml with dichlorobenzene, added and well shaken with 100 ml of silver nano plate aqueous dispersion described in Example 2, subjected to extracting operation and left alone, which resulted an organic phase with a fairly pale light blue color. Since the water phase that presented the pale light blue color became completely colorless while being left alone, most of the plate-like silver nanoparticles in the water phase seemed to have moved to the organic phase and condensed upon forming a composite with the naturally-derived lipophilic clay. The condensation rate numerically reached 100 ml/2 ml=50 times.

Next, polyvinyl butyral resin was added to this organic phase solution to 0.005% by weight to obtain a paint material. Subsequently, an equivalent amount of ethanol was added to said material, and the resultant was applied onto a glass substrate that had underwent alkaline wash. The resultant was heat dried with a drier. As a result, a coating having almost colorless and transparent interference fringes was formed, which was confirmed to keep adhesion even upon contact with alcohol. Moreover, the surface resistance of said coating was measured to be at a value of around $10^3$ Ω/sq. at normal temperature and pressure showing a level comparable to that of Example 2, confirming an effect of significantly increasing conductivity that was higher by six figures or more than that in the case of glass substrate only.

INDUSTRIAL APPLICABILITY

The structure of the present invention can be formed into a film-like support or formed into a film for application to an antistatic film, a conductive film, a transparent conductive film, an antireflective film, a transparent electrode for electronic paper, an antibacterial film, a catalyst carrier film, a light scattering coating film, mother paste, a plasmonic collector film or the like, or can be coated on a semiconductor or the like for application to a flexible solar cell, a photoelectric converter device such as electroluminescence, an optical capacitor, an optical storage battery or the like.

The invention claimed is:

1. A composition comprising composite particles, wherein the composite particles comprise metal particles and a lipophilic clay-based intercalation compound at a weight ratio represented by weight of lipophilic clay-based intercalation compound /weight of metal particles of 0.05 to 20, wherein the metal particles are plate shaped metal particles, where the thickness thereof is 1 nm to 50 nm and the long axis of the principal plane thereof is 10 nm to 5000 nm; wherein the surfaces of the plate shaped metal particles are covered by lipophilic clay-based intercalation compound; wherein the metal particles is at least one-selected from a group consisting of gold, silver, copper, platinum, palladium and rhodium; and the metal particles are positively charged; and wherein the lipophilic clay-based intercalation compound is a clay mineral represented by the following general formula:

$$(X,Y)_{2-3}Z_4O_{10}(OH)_2 \cdot mH_2O \cdot (W_{1/3}),$$

where X=Al, Fe(III), Mn(III), Cn(III); Y=Mg, Fe(II), Mn(II), Ni, Zn, Li; Z=Si, Al; W=K, Na, Ca; $H_2O$ is interlayer water; and m is an integer and the lipophilic clay-based intercalation compound is negatively charged, so that the metal particles and the lipophilic clay-based intercalation compound are attracted to each other to form the composition composite particles.

2. The composition according to claim 1, wherein the aspect ratio of the plate shaped metal particles is 3 to 5000.

3. The composition according to claim 1, wherein the metal particles contain silver.

4. The composition according to claim 1, wherein the lipophilic clay-based intercalation compound is a synthetic compound.

5. The composition according to claim 1, wherein the composite particles are dispersed into a dispersion solution to form of a film.

6. The composition according to claim 5, wherein a thickness of the film shaped structure is 10 μm or less.

7. A method for producing a coating film comprising composite particles containing metal particles and a lipophilic clay-based intercalation compound at a weight ratio represented by weight of lipophilic clay-based intercalation compound/weight of metal particles of 0.05 to 20, the method comprising Steps 1 to 3 below:

Step 1: step of preparing a dispersion solution containing metal particles, a clay-based intercalation compound and a liquid dispersion medium such that the weight ratio represented by weight of lipophilic clay-based intercalation compound/weight of metal particles is 0.05 to 20, and the surfaces of the plate shaped metal particles are covered by the lipophilic clay-based intercalation compound to form the composite particles;

Step 2: step of coating the dispersion solution on a support to obtain a coating film; and Step 3: step of removing the liquid dispersion medium from the coating film, wherein the metal particles are plate shaped metal particles, where the thickness thereof is 1 nm to 50 nm and the long axis of the principal plane thereof is 10 nm to 5000 nm;

the metal particles is at least one-selected from a group consisting of gold, silver, copper, platinum, palladium and rhodium; and the metal particles are positively charged; and wherein the lipophilic clay-based intercalation compound is a clay mineral represented by the following general formula:

$$(X,Y)_{2-3}Z_4O_{10}(OH)_2 \cdot mH_2O \cdot (W_{1/3}),$$

where X=Al, Fe(III), Mn(III), Cn(III); Y=Mg, Fe(II), Mn(II), Ni, Zn, Li; Z=Si, Al; W=K, Na, Ca; $H_2O$ is interlayer water; and m is an integer and the lipophilic clay-based intercalation compound is negatively charged, so that the metal fine particles and the lipophilic clay-based intercalation compound are attracted to each other to form the composite particles.

* * * * *